United States Patent [19]

Röck et al.

[11] Patent Number: 5,056,190

[45] **Date of Patent: * Oct. 15, 1991**

[54] HINGE WITH HINGE ARM RELEASABLY CONNECTED TO MOUNTING PLATE

[75] Inventors: Erich Röck, Höchst; Klaus Brüstle; Helmut Rupprechter, both of Lauterach, all of Austria

[73] Assignee: Julius Blum Gesellschaft m.b.H., Höchst, Austria

[ * ] Notice: The portion of the term of this patent subsequent to Jan. 31, 2006 has been disclaimed.

[21] Appl. No.: 435,811

[22] Filed: Nov. 13, 1989

Related U.S. Application Data

[60] Continuation-in-part of Ser. No. 246,073, Sep. 19, 1988, Pat. No. 4,888,853, and Ser. No. 246,074, Sep. 19, 1988, Pat. No. 4,882,808, each is a division of Ser. No. 878,868, Oct. 3, 1985, Pat. No. 4,800,622.

[30] Foreign Application Priority Data

| | | | |
|---|---|---|---|
| Oct. 19, 1984 | [AT] | Austria | 3336/84 |
| Oct. 19, 1984 | [AT] | Austria | 3337/84 |
| May 9, 1985 | [AT] | Austria | 1393/85 |
| Aug. 19, 1985 | [AT] | Austria | 2404/85 |
| Nov. 16, 1988 | [AT] | Austria | 2806/88 |

[51] Int. Cl.[5] ..... E05D 7/06

[52] U.S. Cl. ..... 16/240; 16/246; 16/257; 16/382; 16/DIG. 43

[58] Field of Search ..... 16/238, 240, 246, 237, 16/382, DIG. 43, 257

[56] References Cited

U.S. PATENT DOCUMENTS

| | | | |
|---|---|---|---|
| 3,952,366 | 4/1976 | Rock et al. . | |
| 3,969,787 | 7/1976 | Rock et al. . | |
| 3,977,041 | 8/1976 | Rock et al. . | |
| 4,068,349 | 1/1978 | Rock et al. . | |
| 4,430,771 | 2/1984 | Salice . | |
| 4,768,259 | 9/1988 | Rock et al. | 16/382 |
| 4,799,289 | 1/1989 | Grass | 16/240 |
| 4,800,622 | 1/1989 | Rock et al. | 16/DIG. 43 |
| 4,882,808 | 11/1989 | Rock et al. | 16/240 |
| 4,888,853 | 12/1989 | Rock et al. | 16/240 |

FOREIGN PATENT DOCUMENTS

| | | | |
|---|---|---|---|
| 297523 | 3/1972 | Austria . | |
| 352577 | 9/1979 | Austria . | |
| 360856 | 2/1980 | Austria . | |
| 371205 | 6/1983 | Austria . | |
| 2044096 | 3/1972 | Fed. Rep. of Germany . | |
| 2460127 | 6/1976 | Fed. Rep. of Germany . | |
| 2719890 | 11/1977 | Fed. Rep. of Germany . | |
| 3119571 | 12/1982 | Fed. Rep. of Germany . | |
| 3241284 | 5/1984 | Fed. Rep. of Germany . | |
| 8602402 | 4/1986 | PCT Int'l Appl. | 16/238 |

*Primary Examiner*—Robert L. Spruill
*Assistant Examiner*—Carmine Cuda
*Attorney, Agent, or Firm*—Wenderoth, Lind & Ponack

[57] ABSTRACT

A hinge has a hinge arm which is connected by hinge links with a hinge casing and is mounted on a mounting plate by a joint adjusting screw and a depth adjusting screw. The hinge arm is, at an end thereof which is close to the pivot axis of the hinge, engageable with the mounting plate by a rigid hook and is pivotable about this point of engagement. At its opposite end, the hinge arm has structure forming a resilient snap connection which engages the mounting plate and maintains the hinge arm mounted on the mounting plate. The structure forming the resilient snap connection has extending therefrom a handle member for enabling the resilient snap connection to be released by lifting the handle member away from the mounting plate.

25 Claims, 1 Drawing Sheet

HINGE WITH HINGE ARM RELEASABLY CONNECTED TO MOUNTING PLATE

This is a continuation-in-part of application Ser. No. 246,073, filed Sept. 19, 1988, now U.S. Pat. No. 4,888,853, and of application Ser. No. 246,074, filed Sept. 19, 1988, now U.S. Pat. No. 4,882,808, which in turn are divisions of application Ser. No. 878,868 corresponding to PCT/AT85/00037, filed Oct. 3, 1985, and now U.S. Pat. No. 4,800,622.

FIELD AND BACKGROUND OF THE INVENTION

The present invention relates to a hinge of the resilient snap-in mounting type and including a hinge arm which is connected with a hinge casing by means of hinge links or the like and which is mounted on a mounting plate by means of a joint adjusting screw and a depth adjusting screw. The hinge arm, at an end thereof which is close to a pivot axis of the hinge, is engageable with the mounting plate by means of a rigid hook and is pivotable about this point of engagement. At its opposite end the hinge arm has means for a resilient snap connection with the mounting plate and maintains the hinge arm mounted on the mounting plate.

Such hinge has the advantage that no tool is necessary for mounting a furniture door to a body of an article of furniture. For anchoring the hinge arm to the mounting plate, it is sufficient to engage the hinge arm in the mounting plate and then to press it onto the mounting plate.

SUMMARY OF THE INVENTION

It is the object of the invention to provide a hinge of the afore-mentioned type in which however the hinge arm is not only easily lockable on the mounting plate but also easily releasable therefrom without a tool.

This is achieved in accordance with the invention by providing that the resilient snap connection forming means of the hinge arm has extending from an end thereof handle means for enabling the resilient snap connection to be released by lifting the handle means from the mounting plate, thereby rotating the hinge arm about a pivot axis or bearing at an opposite end of the mounting plate and thus releasing the hinge arm from the mounting plate.

Releasing of the interengagement of the locking means and lifting the rear end of the hinge arm from the mounting plate is done with a movement in the same direction and can be effected without interruption.

When removing the hinge arm, a user can, for example, rest a thumb on the hinge arm and with an index or middle finger move the handle member to the hinge arm (away from the mounting plate). The hinge arm is removed from the base plate with a steady movement of the hand directed in one and the same direction.

This object is achieved in accordance with another aspect of the invention in that the mounting plate has a U-shaped cross-section in the region of an intermediate member and that hooks of the intermediate member engage at a center flange of the U-shaped profile of the mounting plate.

It is advantageously provided that the intermediate member is provided at the side thereof directed toward the mounting plate with a bulge or projection that extends into an opening of the mounting plate. Due to this arrangement, self-centering of the intermediate member and hinge arm relative to the mounting plate is obtained when the intermediate member is being mounted on the mounting plate.

It is advantageously provided that in the region of a rigid hook of the intermediate member a longitudinal distance is provided between the front of the mounting plate and the intermediate member. It is further advantageously provided that the intermediate member is made in one piece from plastics material and that the mounting plate is made of sheet steel.

A further embodiment of the invention provides that the intermediate member has at its front above or aligned with the rigid hook a T-shaped recess into which extends a head of a joint adjusting screw.

To be able to release the intermediate member more easily, a handle member is formed at that end of the intermediate member provided with a resilient hook, the resilient hook and the handle member extending generally in opposite directions.

Easier mounting and vertical adjustment of the mounting plate is obtained by providing the mounting plate at two lateral parallel flanges thereof with laterally projection mounting flaps which preferably have oblong holes.

BRIEF DESCRIPTION OF THE DRAWINGS

In the following an embodiment of the invention will be described in more detail with reference to the accompanying drawings, in which.

Figure 1:
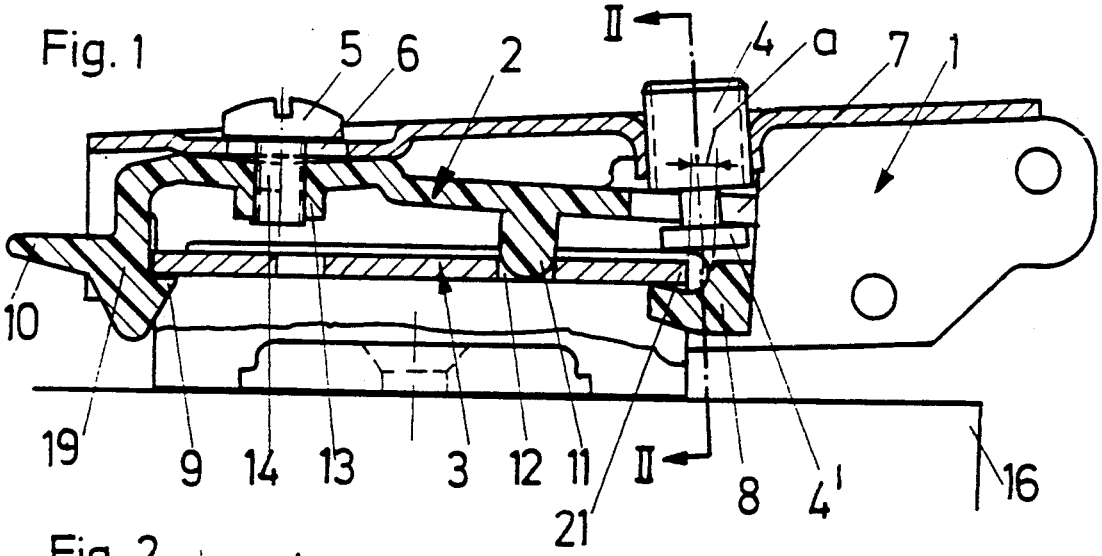
FIG. 1 is a longitudinal sectional view of a hinge according to the invention.
Figure 2:
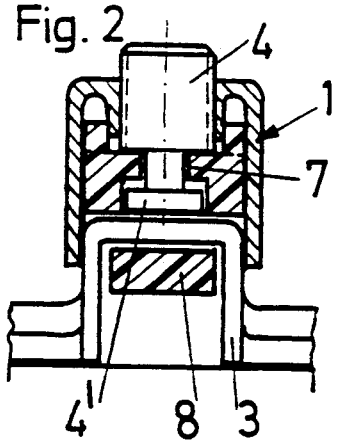
FIG. 2 is a cross-sectional view taken along line II—II of FIG. 1.
Figure 5:
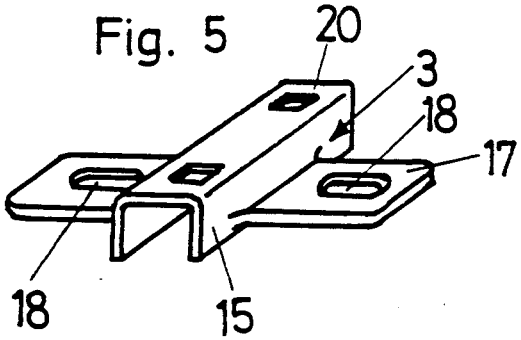
FIG. 5 is a perspective view of a mounting plate.
Figure 3:
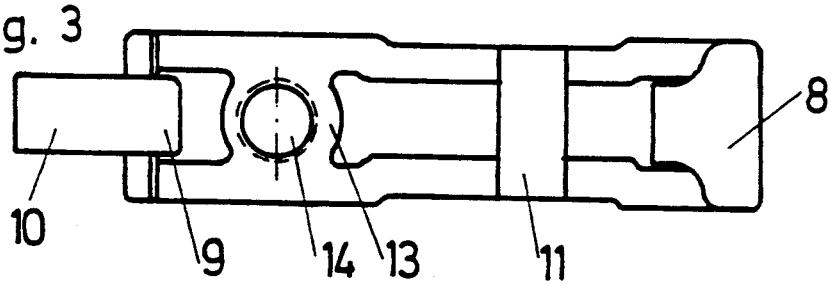
FIG. 3 is an elevation view of an intermediate member from below.
Figure 4:
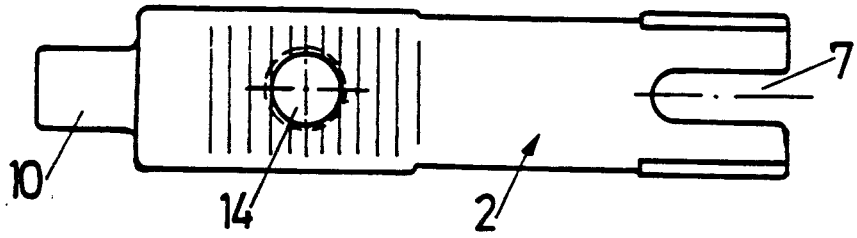
FIG. 4 is a top view of the intermediate member.

Those parts of the hinge which are not associated with the present invention, such as a hinge casing and hinge links, are not shown in the drawings for the sake of clarity and simplicity of illustration. The description similarly does not refer to such parts, and they can be made according to the known state of the art.

DESCRIPTION OF THE PREFERRED EMBODIMENT

The basic parts of the hinge of the present invention are a hinge arm 1, an intermediate member 2 and a mounting plate 3. The mounting plate is punched from sheet steel, and the intermediate member 2 is injection molded of plastics material.

The cross-section of the mounting plate 3 is U-shaped and in the mounted position the mounting plate 3 abuts with two lateral flanges 15 thereof on a furniture side wall 16. Mounting flaps 17 project from the lateral parallel flanges 15. The mounting flaps 17 have oblong holes 18 through which screws or the like extend.

The intermediate member 2 is connected to the hinge arm 1 by means of a joint adjusting screw 4 and a depth adjusting screw in the form of a clamping screw 5. The clamping screw 5 extends through a slot 6 in the hinge arm 1 and engages in a thread 14 in the intermediate member 2.

In the region of the thread 14, the intermediate member 2 is provided with a thickened portion 13 At its front end, the intermediate member 2 is provided with a T-shaped slot or recess 7 that is located directly above a hook 8. A head 4' of joint adjusting screw 4 extends into recess 7. By turning the joint adjusting screw 4, when the hinge is in a mounted position, the distance of hinge arm axles of hinge links from the furniture side wall 16 can be adjusted. The intermediate member 2 is provided at its front end with the rigid hook 8 and at its rear end with a resilient hook 9. The hooks 8, 9 engage at opposite ends of a center flange 20 of the mounting plate.

The intermediate member 2 is further provided with a projection or bulge 11 which extends transversely to the length of the intermediate member 2 and is formed with or mounted on the intermediate member 2. In the mounted position, the bulge 11 extends into an opening 12 in the center flange 20 of the mounting plate 3, and the intermediate member 2 is thus positioned with respect to the mounting plate 3.

To achieve mounting of the intermediate member and the hinge arm on the mounting plate, head 4' is fitted in slot 7 and hook 8 is engaged with the front end of flange 7, thus forming a bearing or pivot axis. The intermediate member and hinge arm then are pivoted about this pivot axis, i.e. counterclockwise as viewed in FIG. 1, and resilient hook 9 snaps over a rear end of flange 20, thus achieving a snap-in mounting.

The intermediate member 2 is positioned in the longitudinal direction by bulge 11 abutting an edge of opening 12 in the mounting plate 3 and by a supporting part 19 of the hook 9 abutting the rear end of flange 20. A front end 21 of the center flange 20 adjacent the rigid hook is paced by a distance a from the intermediate member 2.

A handle or lever member 10 is formed with the supporting part 19 opposite the hook 9. To release the hinge, it is necessary only to press handle member 10 away from the furniture side wall 16, thereby releasing hook 9 from flange 20.

The adjustment of the hinge arm 1 in the direction of the depth of the article of furniture is effected by releasing the clamping screw 5 and displacing the hinge arm 1 with respect to the intermediate member 2. The adjustment in the direction of the breadth of the joint is, as already mentioned, effected by turning the joint adjusting screw 4. Because of a certain elasticity of the hinge arm 1, which is made of sheet steel, this joint adjustment can also be effected when the clamping screw 5 is in the fastened condition.

What is claimed is:

1. A hinge comprising:

a mounting plate having first and second ends;

a hinge arm having first and second ends;

said hinge arm having relatively adjacent said first end thereof means cooperative with said first end of said mounting plate for defining a first bearing such that said hinge arm is held relative to said first end of said mounting plate and is pivotable about said first bearing relative to said mounting plate;

said hinge arm having relatively adjacent said second end thereof means cooperative with said second end of said mounting plate for forming a resilient snap connection therebetween and thus defining a second bearing, whereby said hinge arm is mounted on said mounting plate by said first and second bearings; and said resilient snap connection forming means having extending therefrom handle means for enabling said resilient snap connection to be released by lifting said handle means from said mounting plate, and thereby rotating said hinge arm about said first bearing in the same direction as said handle means and thus releasing said hinge arm from said mounting plate.

2. A hinge as claimed in claim 1, wherein said handle means extends in a direction generally away from said first ends of said hinge arm and said mounting plate.

3. A hinge as claimed in claim 1, wherein said handle means comprises a manually movable handle member.

4. A hinge as claimed in claim 1, wherein said snap connection forming means comprises a resilient manner connected to said hinge arm and clamping said second end of said mounting plate.

5. A hinge as claimed in claim 1, further comprising an intermediate member connected to said hinge arm.

6. A hinge as claimed in claim 5, wherein said first bearing defining means comprises a rigid hook at a first end of said intermediate member for engaging said first end of said mounting plate.

7. A hinge as claimed in claim 6, wherein said resilient snap connection forming means comprises a resilient hook at a second end of said intermediate member for snappingly engaging said second end of said mounting plate.

8. A hinge as claimed in claim 7, wherein said intermediate member and said rigid and resilient hooks comprise an integral single member of one-piece construction formed of a plastics material.

9. A hinge as claimed in claim 7, wherein said intermediate member includes, at a portion thereof facing said mounting plate, a projection.

10. A hinge as claimed in claim 9, wherein said mounting plate has therein an opening, and said projection extends into said opening.

11. A hinge as claimed in claim 10, wherein said surface of said first end of said mounting plate is spaced from a corresponding confronting surface of said intermediate member.

12. A hinge as claimed in claim 10, wherein said projection and said opening are elongated in a direction transverse to a longitudinal direction of said hinge arm and said mounting plate, respectively, extending between said first and second ends thereof.

13. A hinge as claimed in claim 7, wherein said handle means extends integrally from said intermediate member adjacent said resilient hook.

14. A hinge as claimed in claim 13, wherein said handle means and said resilient hook extend from said intermediate member in substantially opposite directions.

15. A hinge as claimed in claim 5, further comprising a depth adjusting screw extending through a slot in said hinge arm and threaded into said intermediate member.

16. A hinge as claimed in claim 15, further comprising a joint adjusting screw threaded through said hinge arm and having a head fitting into a recess in said intermediate member.

17. A hinge as claimed in claim 16, wherein said recess comprises an open-ended slot formed in a first end of said intermediate member and said head is longitudinally slidably inserted into said slot.

18. A hinge as claimed in claim 17, wherein said slot is T-shaped.

19. A hinge as claimed in claim 16, wherein said first bearing defining means comprises a rigid hook at a first end of said intermediate member at a position confronting said recess for engaging said first end of said mounting plate.

20. A hinge as claimed in claim 1, wherein said mounting plate has a U-shaped configuration including parallel lateral flanges connected by a center flange.

21. A hinge as claimed in claim 20, wherein said mounting plate is formed of sheet steel.

22. A hinge as claimed in claim 20, wherein said mounting plate has mounting flaps projecting outwardly from said lateral flanges.

23. A hinge as claimed in claim 20, wherein said first bearing defining means comprises a rigid hook engaging said center flange at said first end of said mounting plate, and said resilient snap connection forming means comprises a resilient hook snappingly engaging said center flange at said second end of said mounting plate.

24. A hinge as claimed in claim 20, further comprising an intermediate member connected to said hinge arm, said intermediate member and said rigid and resilient hooks comprise an integral single member of one-piece construction.

25. A hinge as claimed in claim 24, wherein said integral single member is formed of a plastics material.

* * * * *